US009626861B2

(12) United States Patent
Teki et al.

(10) Patent No.: US 9,626,861 B2
(45) Date of Patent: Apr. 18, 2017

(54) WIRELESS DEVICE AND WIRELESS CONTROL SYSTEM

(71) Applicant: SUMITOMO ELECTRIC INDUSTRIES, LTD., Osaka-shi, Osaka (JP)

(72) Inventors: Sei Teki, Osaka (JP); Mitsuru Hirakawa, Osaka (JP)

(73) Assignee: SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 14/888,469

(22) PCT Filed: May 12, 2014

(86) PCT No.: PCT/JP2014/062582
§ 371 (c)(1),
(2) Date: Nov. 2, 2015

(87) PCT Pub. No.: WO2014/185375
PCT Pub. Date: Nov. 20, 2014

(65) Prior Publication Data

US 2016/0171877 A1 Jun. 16, 2016

(30) Foreign Application Priority Data

May 13, 2013 (JP) ..... 2013-101491

(51) Int. Cl.
*G08C 17/02* (2006.01)

(52) U.S. Cl.
CPC ..... *G08C 17/02* (2013.01); *G08C 2201/11* (2013.01); *G08C 2201/112* (2013.01)

(58) Field of Classification Search
CPC ..... G08C 17/02; G08C 2201/11
See application file for complete search history.

(56) References Cited

U.S. PATENT DOCUMENTS 7,230,532 B2 6/2007 Albsmeier et al.
7,777,623 B2 8/2010 Albsmeier et al.
(Continued)

FOREIGN PATENT DOCUMENTS

JP 2011-172111 A 9/2011
JP 4824277 B2 11/2011
JP 2012-239145 A 12/2012

*Primary Examiner* — Dionne H Pendleton
(74) *Attorney, Agent, or Firm* — Drinker Biddle & Reath LLP

(57) ABSTRACT

A wireless device 101 is a wireless device having identification information, and includes: an operation unit 11; a power generating unit 12 that generates electric power by operation on the operation unit 11; a signal generating unit 13 that operates by using the electric power generated by the power generating unit 12 and is capable of outputting a signal of a kind corresponding to the content of each operation on the operation unit 11; a storage unit 15 that operates by using the electric power generated by the power generating unit 12 and nonvolatilely stores the content of an output signal of the signal generating unit 13, the identification information, and reference information; and a transmission control unit 14 that compares the content of the output signal with the reference information when the operation on the operation unit 11 satisfies a predetermined condition, the content of the output signal and the reference information being stored in the storage unit 15, and transits to a transmission permission state in which transmitting a wireless signal including the identification information stored in the storage unit 15 to a different device is permitted when a result of the comparison satisfies a predetermined condition.

8 Claims, 6 Drawing Sheets

(56) References Cited

U.S. PATENT DOCUMENTS

| | | | | |
|---|---|---|---|---|
| 2013/0051806 | A1* | 2/2013 | Quilici | G08C 23/04 398/106 |
| 2015/0054383 | A1* | 2/2015 | Kang | H03K 17/9643 310/319 |
| 2015/0252557 | A1* | 9/2015 | Hashimoto | E03D 5/10 4/406 |
| 2016/0148764 | A1* | 5/2016 | Ruff | G08C 17/02 307/140 |
| 2016/0308469 | A1* | 10/2016 | Horiguchi | G08C 17/02 |

* cited by examiner

FIG. 6

| WIRELESS DEVICE ID | INPUT NUMBER |
| --- | --- |

WIRELESS DEVICE AND WIRELESS CONTROL SYSTEM

TECHNICAL FIELD

The present invention relates to a wireless device and a wireless control system, and particularly relates to a wireless device and a wireless control system that utilize energy harvesting.

BACKGROUND ART

There has been developed an instrument that operates by using electric power generated by energy harvesting for harvesting minute energy from a surrounding environment such as light, heat, and oscillation.

For example, Japanese Patent Publication No. 4824277 (Patent Literature 1) discloses the following technique.

That is, a sensor system includes: at least one voltage generator that converts nonelectric energy into electric energy; at least one energy storage unit connected to a back position of the voltage generator; at least one voltage converter connected to the energy storage unit so that an output signal of the self matches the operation performed by a processor control unit; at least one sensor; and at least one transmission unit that performs wireless transmission of a transmission telegram which is generated by the processor control unit and which includes at least one measured value of the at least one sensor.

In the sensor system, there is provided a semiconductor timer circuit configured by the ULP technique for realizing a long-hour active cycle in the case where the energy supply is imperfect.

The timer circuit is triggered when the voltage of the at least one energy storage unit reaches a predetermined level. After a predetermined time since the time point when the timer circuit is triggered, the timer circuit starts the processor control unit and the transmission unit so as to transmit at least one transmission telegram.

The at least one voltage generator is configured in a size that does not allow the voltage generator to generate sustainably-operating electric power when an attempt is made to directly drive the processor control unit. The transmission telegram further includes one identification code.

CITATION LIST

Patent Literature

Patent Literature 1: Japanese Patent Publication No. 4824277

SUMMARY OF INVENTION

Technical Problem

In the case of utilizing energy harvesting in a wireless device, for example, energy of operation on the wireless device can be converted to electric energy, and information of the wireless device can be wirelessly transmitted to a different device.

It is desired to provide an excellent wireless control system by improving the function, convenience, and the like of a wireless device that utilizes the energy harvesting.

The present invention has been made to solve the above problem. An object of the present invention is to provide a wireless device capable of providing an excellent wireless control system that utilizes energy harvesting, and a wireless control system that includes the wireless device.

Solution to Problem (1) In order to solve the above problem, a wireless device according to a certain aspect of the present invention is a wireless device having identification information, and includes: an operation unit; a power generating unit that generates electric power by operation on the operation unit; a signal generating unit that operates by using the electric power generated by the power generating unit and is capable of outputting a signal of a kind corresponding to the content of each operation on the operation unit; a storage unit that operates by using the electric power generated by the power generating unit and nonvolatilely stores the content of an output signal of the signal generating unit, the identification information, and reference information; and a transmission control unit that compares the content of the output signal with the reference information when the operation on the operation unit satisfies a predetermined condition, the content of the output signal and the reference information being stored in the storage unit, and transits to a transmission permission state in which transmitting a wireless signal including the identification information stored in the storage unit to a different device is permitted when a result of the comparison satisfies a predetermined condition.

(6) In order to solve the above problem, a wireless control system according to a certain aspect of the present invention includes a wireless device that has identification information and transmits a wireless signal, and a control device that receives the wireless signal from the wireless device, and performs a process based on the identification information included in the received wireless signal. The wireless device includes: an operation unit; a power generating unit that generates electric power by operation on the operation unit; a signal generating unit that operates by using the electric power generated by the power generating unit and is capable of outputting a signal of a kind corresponding to the content of each operation on the operation unit; a storage unit that operates by using the electric power generated by the power generating unit and nonvolatilely stores the content of an output signal of the signal generating unit and the identification information; and a transmission control unit that transits to a transmission permission state in which transmitting a wireless signal including the content of the output signal and the identification information stored in the storage unit to the control device is permitted when the operation on the operation unit satisfies a predetermined condition. The control device compares the content of the output signal included in the wireless signal received from the wireless device with reference information, and performs a process based on the identification information included in the received wireless signal, when a result of the comparison satisfies a predetermined condition.

The present invention can not only realize a wireless device equipped with the above characteristic processing units (such as the signal generating unit and the transmission control unit), but also realize a wireless transmission method including a characteristic process thereof as a step, and realize a program for making a computer execute the step.

The characteristic processing units can also be realized as a semiconductor integrated circuit that realizes a part or a whole of processes that the processing units perform.

Advantageous Effects of Invention

According to the present invention, an excellent wireless control system that utilizes energy harvesting can be provided.

BRIEF DESCRIPTION OF DRAWINGS

FIG. 6 is a diagram illustrating an example of information to be transmitted by the wireless device according to an embodiment of the present invention.

DESCRIPTION OF EMBODIMENTS

Figure 1:
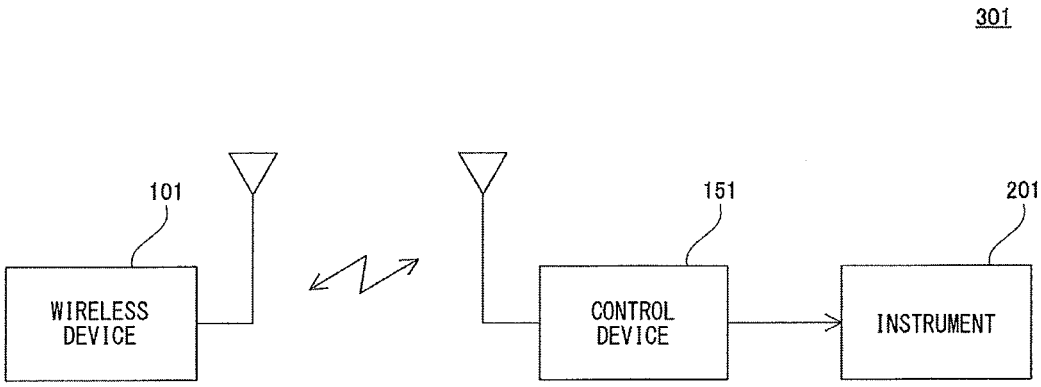
FIG. 1 is a diagram illustrating a configuration of a wireless control system according to an embodiment of the present invention.

First, contents of embodiments of the present invention will be described by listing.

(1) In order to solve the above problem, a wireless device according to a certain aspect of the present invention is a wireless device having identification information, and includes: an operation unit; a power generating unit that generates electric power by operation on the operation unit; a signal generating unit that operates by using the electric power generated by the power generating unit and is capable of outputting a signal of a kind corresponding to the content of each operation on the operation unit; a storage unit that operates by using the electric power generated by the power generating unit and nonvolatilely stores the content of an output signal of the signal generating unit, the identification information, and reference information; and a transmission control unit that compares the content of the output signal with the reference information when the operation on the operation unit satisfies a predetermined condition, the content of the output signal and the reference information being stored in the storage unit, and transits to a transmission permission state in which transmitting a wireless signal including the identification information stored in the storage unit to a different device is permitted when a result of the comparison satisfies a predetermined condition.

With this configuration, the content of operation on the operation unit can be stored in the storage unit by using the electric power generated by the operation. Concerning the content of a series of operations on the operation unit, a higher-level condition can be set for transmitting the wireless signal including identification information of the wireless device. Accordingly, the wireless device can exhibit high functionality by effectively using the electric power generated by the power generating unit.

For example, as compared with the configuration of setting a condition of the content of a series of operations on the operation unit in the above different device, a data length of the information to be transmitted from the wireless device to the different device can be shortened. Therefore, radio wave interference due to the transmission of the wireless signal can be reduced. Further, because the content of a series of operations on the operation unit is not transmitted to the outside of the wireless device, security can be enhanced. Therefore, an excellent wireless control system that utilizes energy harvesting can be provided.

(2) Preferably, the wireless device further includes an erasing unit that erases the content of the output signal stored in the storage unit in response to the transition of the transmission control unit to the transmission permission state.

With this configuration, unnecessary information is prevented from being held in the storage unit, and efficiency of using the storage region of the storage unit can be enhanced. Further, password information such as a code number input by a user can be prevented from remaining in the wireless device, and security can be enhanced.

(3) Preferably, when the transmission of the wireless signal is completed, the transmission control unit transits to a transmission non-permission state in which transmitting the wireless signal to a different device is not permitted.

With this configuration, unlimited continuation of a transmission permission state can be prevented, and security can be enhanced.

(4) Preferably, the operation unit includes a plurality of buttons having different sizes, and the predetermined condition is that the button having a larger size is pressed.

As described above, by configuring the button that serves as a trigger of decision of transition to the transmission permission state to be larger than other buttons, the power generating unit can generate larger electric power, and the transition to the transmission permission state can be executed more securely.

(5) Preferably, the reference information is password information, and the transmission control unit transits to the transmission permission state in the case where the content of the output signal stored in the storage unit coincides with the password information.

With this configuration, it becomes possible to apply a wireless control system to a system that requires high security.

(6) In order to solve the above problem, a wireless control system according to a certain aspect of the present invention includes a wireless device that has identification information and transmits a wireless signal, and a control device that receives the wireless signal from the wireless device, and performs a process based on the identification information included in the received wireless signal. The wireless device includes: an operation unit; a power generating unit that generates electric power by operation on the operation unit; a signal generating unit that operates by using the electric power generated by the power generating unit and is capable of outputting a signal of a kind corresponding to the content of each operation on the operation unit; a storage unit that operates by using the electric power generated by the power generating unit and nonvolatilely stores the content of an output signal of the signal generating unit and the identification information; and a transmission control unit that transits to a transmission permission state in which transmitting a wireless signal including the content of the output signal and the identification information stored in the storage unit to the control device is permitted when the operation on the operation unit satisfies a predetermined condition. The control device compares the content of the output signal included in the wireless signal received from the wireless device with reference information, and performs a process based on the identification information included in the received wireless signal, when a result of the comparison satisfies a predetermined condition.

As described above, the content of the operation on the operation unit is stored in the storage unit by using the electric power generated by the operation. When the content of the operation on the operation unit satisfies a predetermined condition, the wireless control system transmits the wireless signal including the stored content of the operation and the identification information of the wireless device, by using the electric power obtained from the electric wave transmitted from the control device or the electric power generated by the power generating unit, for example. With this configuration, transmitting a wireless signal at each occurrence of operation on the operation unit can be avoided, and radio wave interference due to transmission of a wireless signal can be reduced while effectively utilizing the electric power.

Further, in the wireless device, the control device can set a condition of the content of a series of operations on the operation unit without setting a transmission condition of a wireless signal concerning a relationship between the content of a series of operations on the operation unit and the reference information. Therefore, a process of the wireless device can be simplified, and a power generation condition and the like in the wireless device can be reduced. Further, concerning the content of a series of operations on the operation unit, a higher-level condition for transmission in the process based on identification information of the wireless device can be set. Accordingly, the wireless control system can exhibit high functionality. Therefore, an excellent wireless control system that utilizes energy harvesting can be provided.

(7) Preferably, the wireless device further includes an erasing unit that erases the content of the output signal stored in the storage unit in response to completion of transmission of the wireless signal.

With this configuration, efficiency of using a storage region of the storage unit can be enhanced, password information such as a code number input by a user can be prevented from remaining in the wireless device, and security can be enhanced.

(8) Preferably, the reference information is password information, and the control device performs a process based on the identification information included in the wireless signal in the case where the content of the output signal included in the received wireless signal coincides with the password information.

With this configuration, it becomes possible to apply a wireless control system to a system that requires high security.

Hereinafter, embodiments of the present invention will be described with reference to the drawings. In the drawings, identical or corresponding portions are attached with the same reference signs, and the description thereof will not be repeated.

First Embodiment

FIG. 1 is a diagram illustrating a configuration of a wireless control system according to the embodiment of the present invention.

Referring to FIG. 1 a wireless control system 301 includes a wireless device 101 and a control device 151.

The wireless device 101 transmits a wireless signal to the control device 151 in accordance with user's operation. In addition, for example, the wireless device 101 receives a wireless signal transmitted from the control device 151.

The control device 151 receives the wireless signal transmitted from the wireless device 101, and, for example, controls an instrument 201 based on the information included in the received wireless signal. The control device 151 may be configured to include the instrument 201 that is an object to be controlled.

Alternatively, the control device 151 may be configured to receive a wireless signal transmitted from the wireless device 101, generate some information from the information included in the received wireless signal, and transmit the wireless signal including the generated information to the wireless device 101.

The wireless device 101 utilizes energy harvesting which harvests minute energy from a surrounding environment such as light, heat, and oscillation, and operates by using electric power generated by the energy harvesting. Specifically, the wireless device 101 operates by using the electric power obtained by user's operation on the operation unit of the wireless device 101.

For example, the wireless control system 301 can also be applied to RFID (Radio Frequency Identification). In this case, the wireless device 101 corresponds to an RF tag, and the control device 151 corresponds to a reader/writer.

Figure 2:
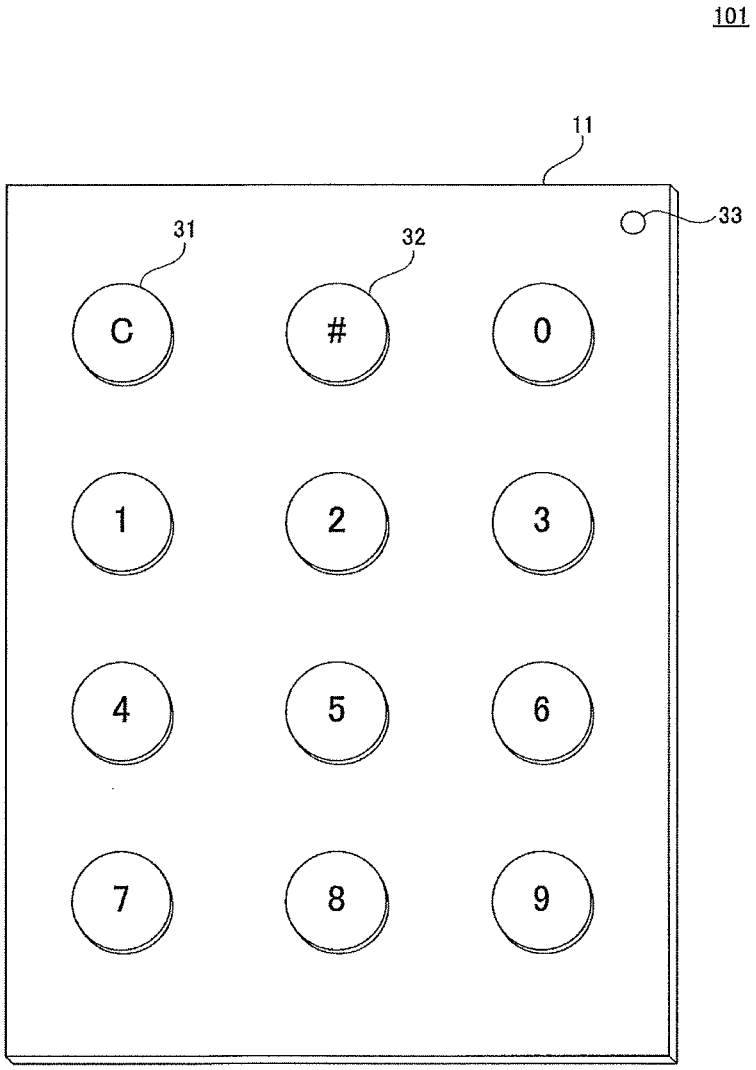
FIG. 2 is a diagram illustrating an example of an operation unit of a wireless device according to an embodiment of the present invention.

FIG. 2 is a diagram illustrating an example of an operation unit of a wireless device according to the embodiment of the present invention.

Referring to FIG. 2, an operation unit 11 of the wireless device 101 includes number buttons 0 to 9, a clear button 31, an input end button 32, and an LED 33.

The user operates the wireless device 101 by pressing each button in the operation unit 11.

The LED 33 is kept lit during a constant period, and notifies the user that the operation is successful, in the case where the strength of pressing the button in the operation unit 11 is sufficient.

The operation unit 11 is not limited to be configured to include the buttons, and may be configured to include a dial and the like. The operation unit 11 is not limited to be configured to include the number buttons, and may be configured to include alphabet buttons, for example.

Figure 3:
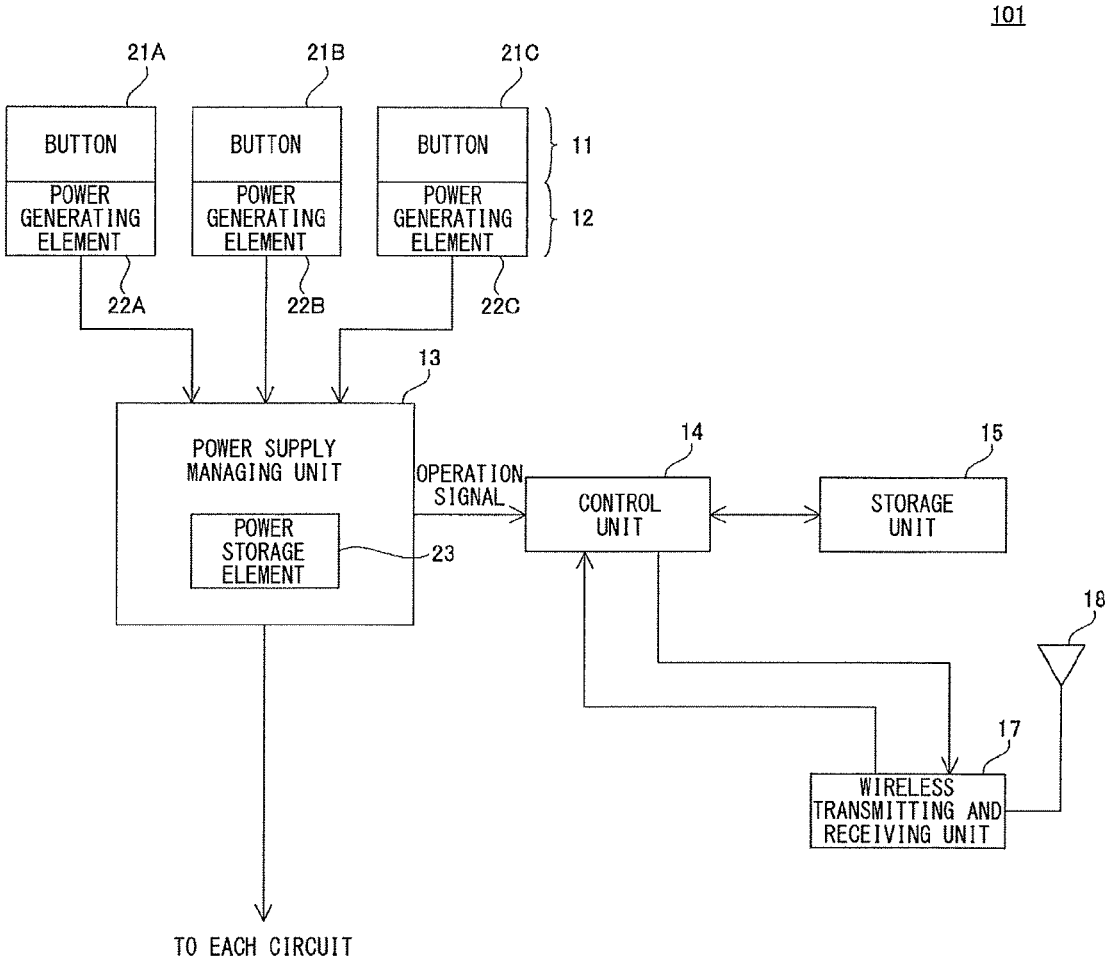
FIG. 3 is a diagram illustrating a configuration of the wireless device according to an embodiment of the present invention.

FIG. 3 is a diagram illustrating a configuration of the wireless device according to the embodiment of the present invention.

Referring to FIG. 3, the wireless device 101 includes the operation unit 11, a power generating unit 12, a power supply managing unit (a signal generating unit) 13, a control unit (a transmission control unit and an erasing unit) 14, a storage unit 15, a wireless transmitting and receiving unit 17, and an antenna 18. The power supply managing unit 13 includes a power storage element 23.

The operation unit 11 includes a plurality of buttons, for example. FIG. 3 representatively illustrates three buttons 21A, 21B, and 21C.

The power generating unit 12 generates electric power by operation on the operation unit 11. The power generating unit 12 includes power generating elements 22A, 22B, and 22C that are provided corresponding to the buttons 21A, 21B, and 21C, respectively.

Hereinafter, each of the buttons 21A, 21B, and 21C may also be referred to as a button 21. Each of the power generating elements 22A, 22B, and 22C may also be referred to as a power generating element 22.

The power generating element 22 is provided at a lower part of the corresponding button 21, generates electric power from energy generated by pressing the corresponding button 21, and outputs the electric power to the power supply managing unit 13.

Specifically, the power generating unit 12 may generate electric power by a change with time of a magnetic flux using a spring, a permanent magnet, and an induction coil, like the technique described in Japanese Patent Publication No. 4225792 (Patent Literature 2), for example. Further, pressing of the button 21 by a user causes the power generating unit 12 to generate stress for elastically deforming the power generating element 22 formed of a piezoelectric element, a magnetostrictive material, or a super-magnetostrictive material, and then to take out electric power from the power generating element 22 by the elastic deformation. For the magnetostrictive material and the super-magnetostrictive material, there are known an Fe—Co alloy, an Fe—Ga alloy, and a Tb—Dy—Fe alloy, for example. However, any material having a reverse magnetostrictive effect may be used.

As described above, an arbitrary system of converting mechanical energy generated by the pressing of the button 21 by a user, into electric energy via various physical phenomena can be applied to the power generating unit 12.

The power storage element 23 in the power supply managing unit 13 is a secondary battery or a capacitor, for example. The power storage element 23 stores energy by the electric power supplied from the power generating unit 12, and supplies electric power to each circuit in the power supply managing unit 13 and in the wireless device 101.

Further, the power supply managing unit 13 monitors the state of the power storage element 23, and prevents overcharge and overdischarge of the power storage element 23. More specifically, when the voltage of the power storage element 23 rises and reaches a predetermined threshold value, the power supply managing unit 13 starts power supply to each circuit, and when the voltage of the power storage element 23 falls and reaches a predetermined threshold value, the power supply managing unit 13 stops power supply to each circuit, for example.

Further, each circuit in the wireless device 101 can operate by using the electric power generated by latest operation on the operation unit 11, and can also operate by using the electric power generated by the past operation on the operation unit 11.

The wireless transmitting and receiving unit 17 generates a wireless signal including the information received from the control unit 14, and transmits the wireless signal to the control device 151 via the antenna 18. Further, the wireless transmitting and receiving unit 17 receives the wireless signal transmitted from the control device 151 via the antenna 18, and outputs the information included in the received wireless signal to the control unit 14.

The wireless transmitting and receiving unit 17 operates by using electric power obtained from an electric wave transmitted from the control device 151, for example. Alternatively, the wireless transmitting and receiving unit 17 receives supply of energy from the control device 151 by magnetic flux coupling of a coil included in the wireless device 101 and a coil included in the control device 151, and exchanges information with the control device 151. The wireless transmitting and receiving unit 17 may be configured to operate by using electric power generated by the power generating unit 12.

The power supply managing unit 13 operates by using the electric power generated by the power generating unit 12, and can output to the control unit 14 an operation signal of a kind corresponding to the content of each operation on the operation unit 11.

More specifically, the power supply managing unit 13 can determine the power generating unit 12 as a supply source of the electric power. The power supply managing unit 13 generates an operation signal indicating the button 21 pressed in the operation unit 11, and outputs the operation signal to the control unit 14. Specifically, the operation signal is a signal indicating which one of number buttons 0 to 9 is pressed, or which one of the clear button 31 and the input end button 32 is pressed.

The storage unit 15 is a flash memory, for example, operates by using the electric power generated by the power generating unit 12, and nonvolatilely stores identification information of the wireless device 101 and reference information.

The control unit 14 is a CPU, for example, operates by using the electric power generated by the power generating unit 12, and controls each unit in the wireless device 101.

For example, the control unit 14 outputs the content of the operation signal received from the power supply managing unit 13 to the storage unit 15. For example, the control unit 14 performs a process according to the content of the operation signal received from the power supply managing unit 13, that is, a process according to the content of the operation on the operation unit 11.

More specifically, the control unit 14 analyzes the operation signal received from the power supply managing unit 13. When the operation on the operation unit 11 satisfies a predetermined condition, specifically, for example, in the case where the operation signal expresses the pressing of the input end button 32 in the operation unit 11, the control unit 14 compares the content of the operation signal with the reference information, the content of the operation signal and the reference information being stored in the storage unit 15. In the case where a result of the comparison satisfies a predetermined condition, the control unit 14 transits to a transmission permission state in which transmitting a wireless signal including the identification information stored in the storage unit 15 to the control device 151 is permitted. On the other hand, when a result of the comparison does not satisfy a predetermined condition, the control unit 14 maintains a transmission non-permission state in which transmission of the wireless signal to the control device 151 is not permitted.

Specifically, reference information is password information, for example. In the case where the content of the operation signal stored in the storage unit 15 coincides with the password information, the control unit 14 transits to the transmission permission state. The reference information is not limited to the password information and may be an ID given to a user or a user name, and the like.

For example, the reference information such as the password information can be registered by the user. Specifically, in the case where the user has pressed the number buttons in the order of "123400," for example, the control unit 14 stores "1234" in the storage unit 15 as reference information, because the number button of 0 has been pressed twice.

The control unit 14 is not limited to be configured to transit to the transmission permission state in the case where the content of the operation signal coincides with the reference information at all collation times. The control unit 14 can also transit to the transmission permission state in the case where the content of the operation signal coincides with the reference information at a part of the collation times.

The control unit 14 is not limited to be configured to compare the content of the operation signal stored in the storage unit 15 with the reference information when the input end button 32 in the operation unit 11 is pressed. The control unit 14 may be configured to compare the number of the button which is pressed at a predetermined number of times with the reference information when the number button is pressed at the predetermined number of times, for example.

Further, in response to the transition to the transmission permission state, the control unit 14 erases the content of the operation signal stored in the storage unit 15, that is, information of one or a plurality of numbers input by the user. Accordingly, in the case where the user has lost the wireless device 101, for example, the wireless device 101 can be prevented from being utilized by any other person.

Further, also in the case where the operation signal expresses the pressing of the clear button 31 in the operation unit 11, the control unit 14 erases the content of the operation signal stored in the storage unit 15.

Figure 4:
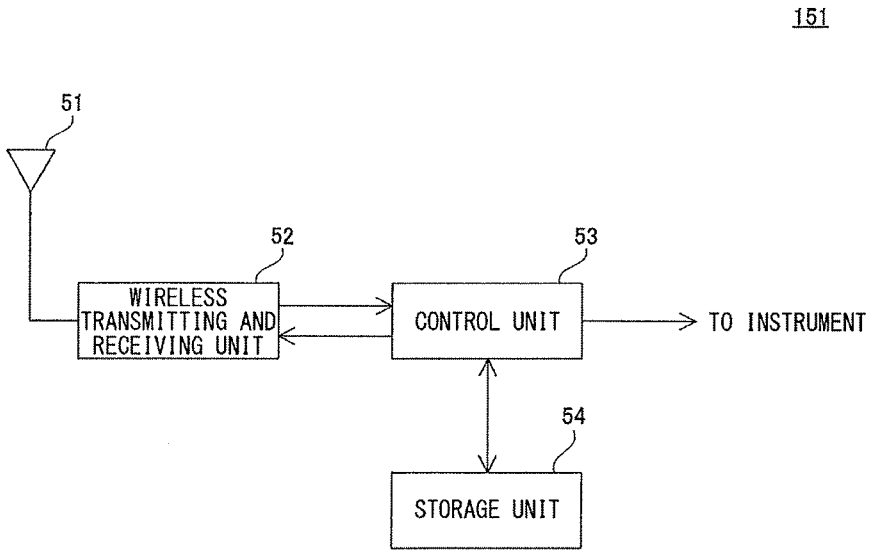
FIG. 4 is a diagram illustrating a configuration of a control device in the wireless control system according to an embodiment of the present invention.

FIG. 4 is a diagram illustrating a configuration of a control device in the wireless control system according to the embodiment of the present invention.

Referring to FIG. 4, the control device 151 includes an antenna 51, a wireless transmitting and receiving unit 52, a control unit 53, and a storage unit 54.

The wireless transmitting and receiving unit 52 receives the wireless signal transmitted from the wireless device 101 via the antenna 51, and outputs the information included in the received wireless signal to the control unit 53.

An example of the operations of the control device 151 and the wireless device 101 in the wireless control system 301 will be described in detail.

Referring to FIG. 3 and FIG. 4, first, in the control device 151, the wireless transmitting and receiving unit 52 constantly transmits a wireless signal of weak electric power via the antenna 51, for example.

Next, when the user brings the wireless device 101 close to the control device 151, the wireless transmitting and receiving unit 17 in the wireless device 101 receives the wireless signal transmitted from the control device 151, and notifies the control unit 14 of the reception of the wireless signal from the control device 151.

Next, in the case where the control unit 14 is in the transmission non-permission state, the control unit 14 ignores the notification. On the other hand, when the control unit 14 receives the notification in the transmission permission state, the control unit 14 reads the identification information stored in the storage unit 15, and outputs the identification information to the wireless transmitting and receiving unit 17. Further, for example, the control unit 14 outputs to the wireless transmitting and receiving unit 17 the information necessary for transmitting a wireless signal.

Next, the wireless transmitting and receiving unit 17 generates a wireless signal including the identification information received from the control unit 14, and transmits the wireless signal to the control device 151 via the antenna 18.

Next, in the control device 151, the wireless transmitting and receiving unit 52 receives the wireless signal transmitted from the wireless device 101, and outputs the identification information of the wireless device 101 included in the received wireless signal to the control unit 53. The control unit 53 performs various kinds of processes by using the identification information, received from the wireless transmitting and receiving unit 52, of the wireless device 101.

Specifically, for example, the control unit 53 outputs a control signal to the instrument 201 based on the identification information received from the wireless transmitting and receiving unit 52. For example, in the case where the wireless control system 301 is applied to the opening and closing of a gate of a building, the control unit 53 compares the identification information, received from the wireless transmitting and receiving unit 52, of the wireless device 101 with the identification information stored in the storage unit 54, and outputs a control signal to the instrument 201 that drives the gate in the case where the identification information of the wireless device 101 coincides with the identification information stored in the storage unit 54.

In the case where the wireless control system 301 is applied to stop control of an elevator at a specific floor, for example, the control unit 53 compares the identification information of the wireless device 101 with a plurality of pieces of the identification information stored in the storage unit 54, for example. In the case where the identification information of the wireless device 101 coincides with any one of the pieces of the identification information stored in the storage unit 54, the control unit 53 outputs a control signal of the content according to the identification information, specifically, a control signal indicating the specific floor, to the instrument 201 that controls the elevator.

Further, in the case where the wireless control system 301 is applied to an electronic money system or a boarding system of a transportation facility, for example, the control unit 14 in the wireless device 101 transmits balance information, together with the identification information, to the control device 151 via the wireless transmitting and receiving unit 17.

Next, in the control device 151, the control unit 53 refers to the received identification information of the wireless device 101, updates the balance information of the wireless device 101 by performing various kinds of arithmetic processes, and transmits the updated balance information to the wireless device 101 via the wireless transmitting and receiving unit 52.

Next, in the wireless device 101, the control unit 14 updates the balance information stored in the storage unit 15 to the balance information received from the control device 151.

The wireless device 101 is not limited to be configured to transmit the wireless signal including the identification information to the control device 151 in a non-contact state with the control device 151, in the transmission permission state. For example, the wireless device 101 as a credit card can transmit the wireless signal in a contact state with the control device 151 as a card reader.

Figure 5:
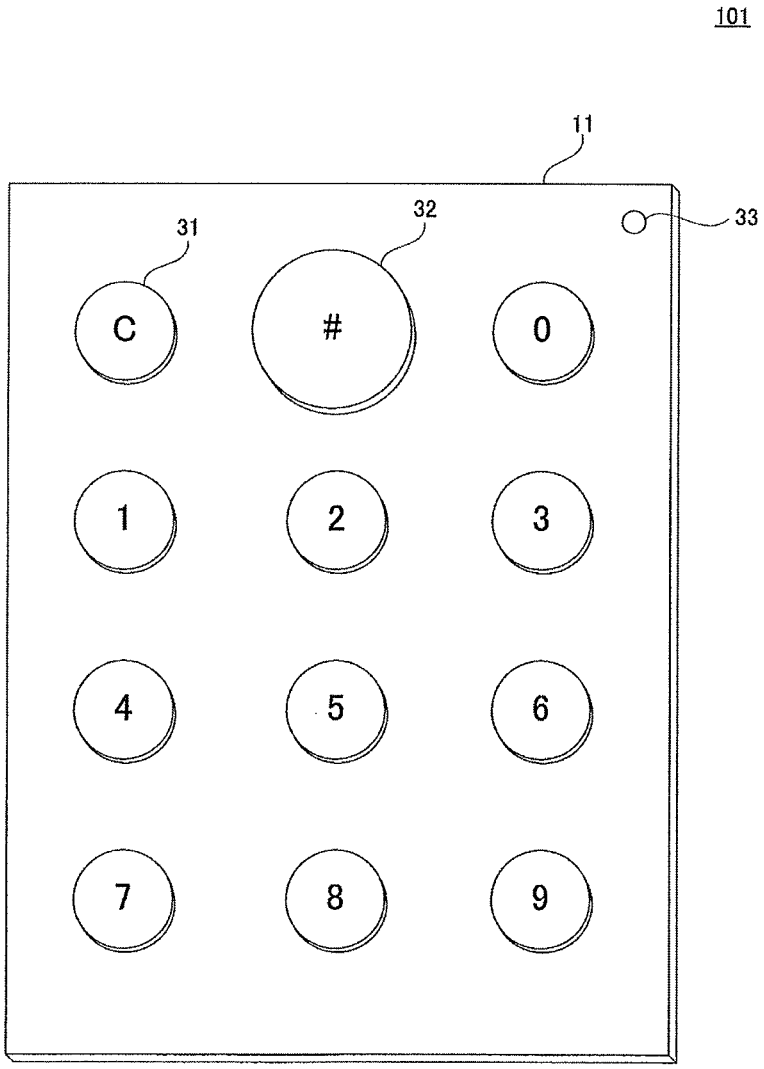
FIG. 5 is a diagram illustrating another example of the operation unit of the wireless device according to an embodiment of the present invention.

FIG. 5 is a diagram illustrating another example of the operation unit of the wireless device according to the embodiment of the present invention.

Referring to FIG. 5, the operation unit 11 in the wireless device 101 includes a plurality of buttons having different sizes.

When a larger button is pressed in the operation unit 11, the control unit 14 compares the content of the operation signal with the reference information, the content of the operation signal and the reference information being stored in the storage unit 15.

Specifically, out of the buttons in the operation unit 11, the input end button 32 is the largest. As described above, in the case where the input end button 32 is pressed, much electric power is necessary in the wireless device 101, because the wireless device 101 reads the content of the operation signal from the storage unit 15, compares the content of the read operation signal with the reference information, and transits to the transmission permission state.

As described above, by making the button that serves as a trigger of transition to the transmission permission state larger than other buttons, the power generating element 22 can generate larger electric power, and can execute more securely a series of operations of the wireless device 101.

Further, the wireless control system 301 may be configured to perform an authentication process by the reference information at the control device 151 side.

That is, in the wireless device 101, when the operation on the operation unit 11 satisfies a predetermined condition, the control unit 14 transits to the transmission permission state in which transmitting a wireless signal including the content of the operation signal and the identification information stored in the storage unit 15 to the control device 151 is permitted.

In the control device 151, the control unit 53 compares the content of the operation signal which is included in the wireless signal received from the wireless device 101 with the reference information. When a result of the comparison satisfies a predetermined condition, the control unit 53 performs a process based on the identification information included in the received wireless signal.

FIG. 6 is a diagram illustrating an example of information to be transmitted by the wireless device according to the embodiment of the present invention.

Referring to FIG. 6, the information transmitted from the wireless device 101 includes the identification information of the wireless device 101, and the content of the operation signal, that is, the number input by the user, for example.

That is, in the wireless device 101, in the case where the control unit 14 is in the transmission permission state, upon receiving the notification, the control unit 14 reads from the storage unit 15 the content of the operation signal in addition to the identification information stored in the storage unit 15, and transmits a read result to the control device 151 via the wireless transmitting and receiving unit 17.

In the present example, the control unit 14 does not erase the content of the operation signal stored in the storage unit 15 in response to the transition to the transmission permission state, but erases the content of the operation signal stored in the storage unit 15 in response to the completion of transmission of the wireless signal by the wireless transmitting and receiving unit 17.

Next, in the control device 151, the control unit 53 compares the content of the operation signal included in the wireless signal received from the wireless device 101 with the reference information, for example, the password information, stored in the storage unit 54. In the case where the content of the operation signal coincides with the reference information, the control unit 53 performs various kinds of processes using the identification information of the wireless device 101. In the case where the content of the operation signal does not coincide with the reference information, the control unit 53 does not perform the process using the identification information of the wireless device 101.

In the case of utilizing energy harvesting in the wireless device, the energy of the operation on the wireless device can be converted to electric energy, and the information of the wireless device can be wirelessly transmitted to a different device. It is desired to provide an excellent wireless control system by improving the function, convenience, and the like of a wireless device that utilizes the energy harvesting.

On the other hand, in the wireless device according to the embodiment of the present invention, the power generating unit 12 generates electric power by the operation on the operation unit 11. The power supply managing unit 13 operates by using the electric power generated by the power generating unit 12, and can output a signal of a kind corresponding to the content of each operation on the operation unit 11. The storage unit 15 operates by using the electric power generated by the power generating unit 12, and nonvolatilely stores the output signal of the power supply managing unit 13, that is, the content of the operation signal, the identification information, and the reference information. When the operation on the operation unit 11 satisfies a predetermined condition, the control unit 14 compares the content of the operation signal with the reference information, the content of the operation signal and the reference information being stored in the storage unit 15. When a result of the comparison satisfies a predetermined condition, the control unit 14 transits to the transmission permission state in which transmitting the wireless signal including the identification information stored in the storage unit 15 to a different device is permitted.

With this configuration, the content of the operation on the operation unit 11 can be stored in the storage unit 15 by using the electric power generated by the operation. Concerning the content of a series of operations on the operation unit 11, a higher-level condition can be set for transmitting the wireless signal including identification information of the wireless device 101. Accordingly, the wireless device 101 can exhibit high functionality by effectively using the electric power generated by the power generating unit 12.

Further, as compared with the configuration of setting a condition of the content of a series of operations on the operation unit 11 in the control device 151, a data length of the information to be transmitted from the wireless device 101 to the control device 151 can be shortened. Therefore, radio wave interference due to the transmission of the wireless signal can be reduced. Further, because the content of a series of operations on the operation unit 11 is not transmitted to the outside of the wireless device 101, security can be enhanced.

Therefore, in the wireless device according to the embodiment of the present invention, an excellent wireless control system that utilizes energy harvesting can be provided.

In the wireless device according to the embodiment of the present invention, the control unit 14 erases the content of the operation signal stored in the storage unit 15 in response to the transition to the transmission permission state.

With this configuration, unnecessary information is prevented from being held in the storage unit 15, and efficiency of using the storage region of the storage unit 15 can be enhanced. Further, password information such as a code number input by a user can be prevented from remaining in the wireless device 101, and security can be enhanced.

In the wireless device according to the embodiment of the present invention, upon completing transmission of the wireless signal, the control unit 14 transits to a transmission non-permission state in which transmitting the wireless signal to a different device is not permitted.

With this configuration, unlimited continuation of a transmission permission state can be prevented, and security can be enhanced.

In the wireless device according to the embodiment of the present invention, the operation unit 11 includes a plurality of buttons 21 having different sizes. A predetermined condition of transition to the transmission permission state is that a larger button 21 is pressed.

As described above, by configuring the button that serves as a trigger of decision of transition to the transmission permission state to be larger than other buttons, the power generating unit 12 can generate larger electric power, and the transition to the transmission permission state can be executed more securely.

In the wireless device according to the embodiment of the present invention, the reference information is password information. In the case where the content of the operation signal stored in the storage unit 15 coincides with the password information, the control unit 14 transits to the transmission permission state.

With this configuration, it becomes possible to apply a wireless control system to a system that requires high security.

Second Embodiment

In the first embodiment, the wireless device 101 executes the authentication process by using reference information. However, the control device 151 on the receiving side may perform this process. Hereinafter, the content of a second embodiment will be described.

In a wireless control system according to the second embodiment, the wireless device 101 has identification information, and transmits a wireless signal. The control device 151 receives the wireless signal from the wireless device 101, and performs the process based on the identification information included in the received wireless signal.

In the wireless device 101, when the operation on the operation unit 11 satisfies a predetermined condition, the control unit 14 transits to the transmission permission state in which transmitting the wireless signal including the content of the operation signal and the identification information stored in the storage unit 15 to the control device 151 is permitted. The control device 151 compares the content of the operation signal which is included in the wireless signal received from the wireless device 101 with the reference information. When a result of the comparison satisfies a predetermined condition, the control device 151 performs a process based on the identification information included in the received wireless signal.

As described above, the content of the operation on the operation unit 11 is stored in the storage unit 15 by using the electric power generated by the operation. When the content of the operation on the operation unit 11 satisfies a predetermined condition, the wireless signal including the stored content of the operation and the identification information of the wireless device 101 may be transmitted by using the electric power obtained from the electric wave transmitted from the control device 151 or the electric power generated by the power generating unit 12, for example.

With this configuration, transmitting a wireless signal at each occurrence of operation on the operation unit 11 can be avoided, and radio wave interference due to transmission of a wireless signal can be reduced while effectively utilizing the electric power.

Further, according to the second embodiment, in the wireless device 101, the control device 151 can set a condition of the content of a series of operations on the operation unit 11 without setting a transmission condition of a wireless signal concerning a relationship between the content of a series of operations on the operation unit 11 and the reference information. Therefore, a process of the wireless device 101 can be simplified, and a power generation condition and the like in the wireless device 101 can be reduced.

Further, concerning the content of a series of operations on the operation unit 11, a higher-level condition can be set for the transmission of a process based on the identification information of the wireless device 101. Accordingly, the wireless control system 301 can exhibit high functionality.

Therefore, in the wireless control system according to the embodiment of the present invention, an excellent wireless control system that utilizes energy harvesting can be provided.

Further, in the wireless control system according to the embodiment of the present invention, the control unit 14 erases the content of the operation signal stored in the storage unit 15 in response to completion of transmission of the wireless signal.

With this configuration, efficiency of using a storage region of the storage unit 15 can be enhanced, password information such as a code number input by a user can be prevented from remaining in the wireless device 101, and security can be enhanced.

Further, in the wireless control system according to the embodiment of the present invention, reference information is password information. The control unit 53 in the control device 151 performs a process based on the identification information included in the wireless signal in the case where the content of the output signal included in the wireless signal received from the wireless device 101 coincides with the password information.

With this configuration, it becomes possible to apply a wireless control system to a system that requires high security.

It should be considered that the above embodiments are exemplification in all aspects and are not restrictive. The scope of the present invention is expressed by claims, not in the above description, and is intended to include all changes in the equivalent meanings and scope of the claims.

<Others>

In the above embodiments, the predetermined condition concerning the operation on the operation unit 11 (hereinafter referred to as a "first predetermined condition") includes a case where the wireless transmitting and receiving unit 17 of the wireless device 101 is a necessary condition for entering into the transmission permission state and a case where it is a necessary and sufficient condition for entering into in the transmission permission state.

That is, in the case where the first predetermined condition is a necessary condition, the control unit 14 transits to the transmission permission state in the case where another loading condition (a second predetermined condition described later) is satisfied.

Further, in the case where the first predetermined condition is a necessary and sufficient condition, the control unit 14 transits to the transmission permission state in the case where the first predetermined condition is satisfied.

As detailed examples of the first predetermined condition, the following conditions are included, for example.

1) In the wireless device 101 having the input end button 32 (refer to FIG. 2 and FIG. 5), the input end button 32 has been pressed.

2) In the wireless device 101 not having the input end button 32, operation that expresses an end instruction set in advance (such as a double click which is successive pressing of a predetermined button, long-time pressing of a predetermined button, and operating a button of a predetermined number set in advance) has been performed.

In the above embodiments, there are a case where the wireless device 101 determines establishment of an authentication condition for evaluating coincidence between the content of the operation on the operation unit 11 and the reference information (hereinafter, referred to as a "second predetermined condition") and a case where the control device 151 determines the same.

That is, in the case where the wireless device 101 determines establishment of the second predetermined condition, the control unit 14 of the wireless device 101 transits to the transmission permission state based on the condition that both the first predetermined condition and the second predetermined condition are satisfied simultaneously, and the wireless signal does not include the information of the content of the operation.

Conversely, in the case where the control device 151 determines establishment of the second predetermined condition, the control unit 14 of the wireless device 101 transits to the transmission permission state based on the condition that the first predetermined condition is satisfied, and the wireless signal includes the information of the content of the operation.

Then, the control unit 53 of the control device 151 that receives the information of the content of the operation of the wireless signal performs the authentication process by determining whether the second predetermined condition is established.

As detailed examples of the second predetermined condition, the following conditions are included, for example.

1) The content of the operation signal (for example, the button operation of "12345") entirely coincides with the reference information that is a code number set in advance (for example, "12345").

2) The content of the operation signal (for example, the button operation of "12344") partly coincides with the reference information that is a code number set in advance (for example, "12345").

In the above embodiments, there is exemplified the wireless control system which is of a type that transmits and receives a wireless signal via the antennas 18 and 51. However, the wireless control system may be of a type that transmits and receives an optical signal. Therefore, the wireless signal in the present specification includes an optical signal, and an electric wave also includes light.

In the above embodiments, it is assumed that large electric power is obtained by pressing the input end button 32 (refer to FIG. 5) which is larger than the other operation buttons.

However, there can also be a case where the size of the button does not necessarily correspond to the size of the power generation amount. For example, even in the case where only the performance of the power generating element 22 corresponding to the input end button 32 having the same size as those of the other buttons is set higher than the performance of the other power generating elements 22, large electric power can be obtained by pressing the input end button 32. Therefore, the claims of the present application can include the following dependent claim, for example.

The wireless device according to the foregoing claim, wherein the operation unit comprises a plurality of kinds of buttons having different power generation amounts accompanied with operation, and the predetermined condition (first predetermined condition) is that the button of a kind of a larger power generation amount (preferably, a button having a largest power generation amount) is pressed.

REFERENCE SIGNS LIST

11: OPERATION UNIT
12: POWER GENERATING UNIT
13: POWER SUPPLY MANAGING UNIT (SIGNAL GENERATING UNIT)
14: CONTROL UNIT (TRANSMISSION CONTROL UNIT AND ERASING UNIT)
15, 54: STORAGE UNIT
16: SWITCH
17: WIRELESS TRANSMISSION UNIT
18, 51: ANTENNA
21, 21A, 21B, 21C: BUTTON
22, 22A, 22B, 22C: POWER GENERATING ELEMENT
23: POWER STORAGE ELEMENT
31: CLEAR BUTTON
32: INPUT END BUTTON
33: LED
52: WIRELESS RECEIVING UNIT
53: CONTROL UNIT
101: WIRELESS DEVICE
151: CONTROL DEVICE
201: INSTRUMENT
301: WIRELESS CONTROL SYSTEM

The invention claimed is:

1. A wireless device having identification information, comprising:

a mechanical operation unit that generates mechanical energy by being pressed by a user;

a power generating element that is provided corresponding to the mechanical operation unit and generates electric power by converting the mechanical energy generated by the mechanical operation unit into electric energy via various physical phenomena;

an electric circuit that operates by using electric power generated by the power generating element and is capable of outputting a signal of a kind corresponding to a content of each operation on the mechanical operation unit;

a memory that operates by using electric power generated by the power generating unit and nonvolatilely stores a content of an output signal of the signal generating unit, the identification information, and reference information; and a processor that is programmed to compare a content of the output signal with the reference information when the operation on the mechanical operation unit satisfies a predetermined condition, the content of the output signal and the reference information being stored in the memory, and to transit to a transmission permission state in which transmitting a wireless signal comprising the identification information stored in the memory to a different device is permitted when a result of the comparison satisfies a predetermined condition.

2. The wireless device according to claim 1, wherein the processor is further programmed to erase the content of the output signal stored in the memory in response to the transmission permission state.

3. The wireless device according to claim 1, wherein when transmission of the wireless signal is completed, the processor is further programmed to transit to a transmission non-permission state in which transmitting the wireless signal to a different device is not permitted.

4. The wireless device according to claim 1, wherein the mechanical operation unit comprises a plurality of buttons having different sizes, and the predetermined condition is that the button having a larger size is pressed.

5. The wireless device according to claim 1, wherein the reference information is password information, and the processor is further programmed to transit to the transmission permission state in a case where the content of the output signal stored in the storage unit coincides with the password information.

6. A wireless control system comprising:

a wireless device that has identification information and transmits a wireless signal, and a control device that receives the wireless signal from the wireless device, and performs a process based on the identification information comprised in the received wireless signal, wherein the wireless device comprises:

a mechanical operation unit that generates mechanical energy by being pressed by a user;

a power generating element that is provided corresponding to the mechanical operation unit and generates electric power by converting the mechanical energy generated by the mechanical operation unit into electric energy via various physical phenomena;

an electric circuit that operates by using electric power generated by the power generating element and is capable of outputting a signal of a kind corresponding to a content of each operation on the mechanical operation unit;

a memory that operates by using electric power generated by the power generating unit and nonvolatilely stores a content of an output signal of the signal generating unit and the identification information; and a processor that is programmed to transit to a transmission permission state in which transmitting a wireless signal comprising the content of the output signal and the identification information stored in the memory to the control device is permitted when the operation on the mechanical operation unit satisfies a predetermined condition, wherein the control device compares the content of the output signal comprised in the wireless signal received from the wireless device with reference information, and performs a process based on the identification information comprised in the received wireless signal, when a result of the comparison satisfies a predetermined condition.

7. The wireless control system according to claim 6, wherein the processor is further programmed to erase the content of the output signal stored in the memory in response to completion of transmission of the wireless signal.

8. The wireless control system according to claim 6, wherein the reference information is password information, and the control device performs a process based on the identification information comprised in the wireless signal in a case where the content of the output signal comprised in the received wireless signal coincides with the password information.

* * * * *